United States Patent [19]

Ross

[11] Patent Number: 4,859,178

[45] Date of Patent: Aug. 22, 1989

[54] INGOT PUSHER FURNACE WITH MEANS FOR REDUCING HEAT LOSS

[75] Inventor: Robert H. Ross, Meadville, Pa.

[73] Assignee: Seco/Warwick Corporation, Meadville, Pa.

[21] Appl. No.: 232,271

[22] Filed: Aug. 15, 1988

[51] Int. Cl.[4] ..... F27D 1/12

[52] U.S. Cl. ..... 432/237; 432/250; 110/173 R

[58] Field of Search ..... 432/250, 237, 242; 110/180, 173 R, 173 B

[56] References Cited

U.S. PATENT DOCUMENTS

| | | | |
|---|---|---|---|
| 2,033,331 | 3/1936 | De Coriolis et al. | 432/237 |
| 2,254,900 | 9/1941 | Lessmann | 432/250 |
| 2,270,484 | 1/1942 | Wallerius | 432/250 |
| 4,054,411 | 10/1977 | Beck | 110/173 R |
| 4,427,378 | 1/1984 | Bowers | 432/250 |

*Primary Examiner*—Henry C. Yuen

*Attorney, Agent, or Firm*—Davis Chin

[57] ABSTRACT

An ingot pusher furnace includes means for reducing heat loss from the charging and discharging ends of the furnace so as to produce a more efficient and uniform heating of the ingots. The pusher furnace includes support rails which extend between a first opening in the front wall and a second opening in the rear wall and terminates inside of the charging and discharging doors. The charging and discharging doors extend below the support rails in their closed position so as to provide a positive seal.

7 Claims, 3 Drawing Sheets

INGOT PUSHER FURNACE WITH MEANS FOR REDUCING HEAT LOSS

BACKGROUND OF THE INVENTION

This invention relates generally to ingot pusher furnaces and more particularly, it relates to an improved pusher furnace which includes means reducing heat loss from the charging and discharging ends of the furnace so as to produce a more efficient and uniform heating of the ingots.

A prior art furnace 10 is illustrated in FIG. 1 of the drawings and has been labeled "Prior Art." As can be seen, the rails 36 used for support and movement of a plurality of aluminum ingots 38 to be heated into and out of the enclosure 20 actually extend beyond charging end 17 and discharging end 19 of the furnace 10. As a result, there is created a difficult problem in obtaining an efficient sealing of the furnace. The bottoms of the charging door 24 and discharging door 28 in their closed positions will come to rest on the top surface of the rails 36. Thus, there is a great likelihood of outside cold air to leak into the furnace around the rails at the locations where they extend through the respective door openings.

Such influx of cold air has a tendency to upset the temperature uniformity by causing a cold spot or "chill" to be formed on the next ingot to be discharged, which means that the quality of the finished rolled aluminum has been sacrificed. Further, heat loss from the furnace due to the leaks will mean the wasting of energy, thereby reducing its overall efficiency.

It would therefore be desirable to provide an improved ingot pusher furnace which includes means for reducing heat loss from the charging and discharging ends of the furnace so as to produce a more efficient and uniform heating of the ingots. This is accomplished in the present invention by the provision of support rails that terminate inside of the charging and discharging doors and by fabricating the doors to extend below the support rails, thereby creating a positive seal on each side of the doors.

SUMMARY OF THE INVENTION

Accordingly, it is a general object of the present invention to provide an improved ingot pusher furnace which is relatively simple and economical to manufacture and assemble, but yet overcomes the disadvantages of the prior art furnaces.

It is an object of the present invention to provide an ingot pusher furnace which includes means for reducing heat loss from the charging and discharging ends thereof.

It is another object of the present invention to provide an ingot pusher furnace which includes support rails extending between a first opening in the front wall and a second opening in the rear wall and terminating inside of the charging and discharging doors, the charging and discharging doors extending below the support rails in their closed position so as to provide a positive seal.

In accordance with these aims and objectives, the present invention is concerned with the provision of an improved ingot pusher furnace which includes an insulated furnace enclosure formed by a bottom wall, a front wall, a rear wall and a top wall. The enclosure receives a plurality of ingots to be heated. A plurality of heat sources are provided to heat a gaseous medium within the enclosure. A plurality of fans are provided to circulate the gaseous medium within the enclosure. Support rails are disposed in the bottom wall for facilitating support and movement of the ingots within the enclosure. A charging door located adjacent the front wall is adapted to close a first opening formed in the front wall. A discharging door located adjacent the rear wall is adapted to close a second opening formed in the rear wall. The support rails extend between the first opening in the front wall and the second opening in the rear wall and terminates inside of the charging and discharging doors. The charging and discharging doors extend below the support rails in their closed positions so as to provide a positive seal.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein:

FIG. 2(*b*) is a side elevational view of an ingot pusher furnace of the present invention with an up-ender mechanism illustrating the charging door in the closed position;

FIG. 3(*b*) is a side elevational view an ingot pusher furnace of the present invention with a down-ender mechanism, illustrating the discharging door in the closed position.

DESCRIPTION OF THE PREFERRED EMBODIMENT

Figure 1:
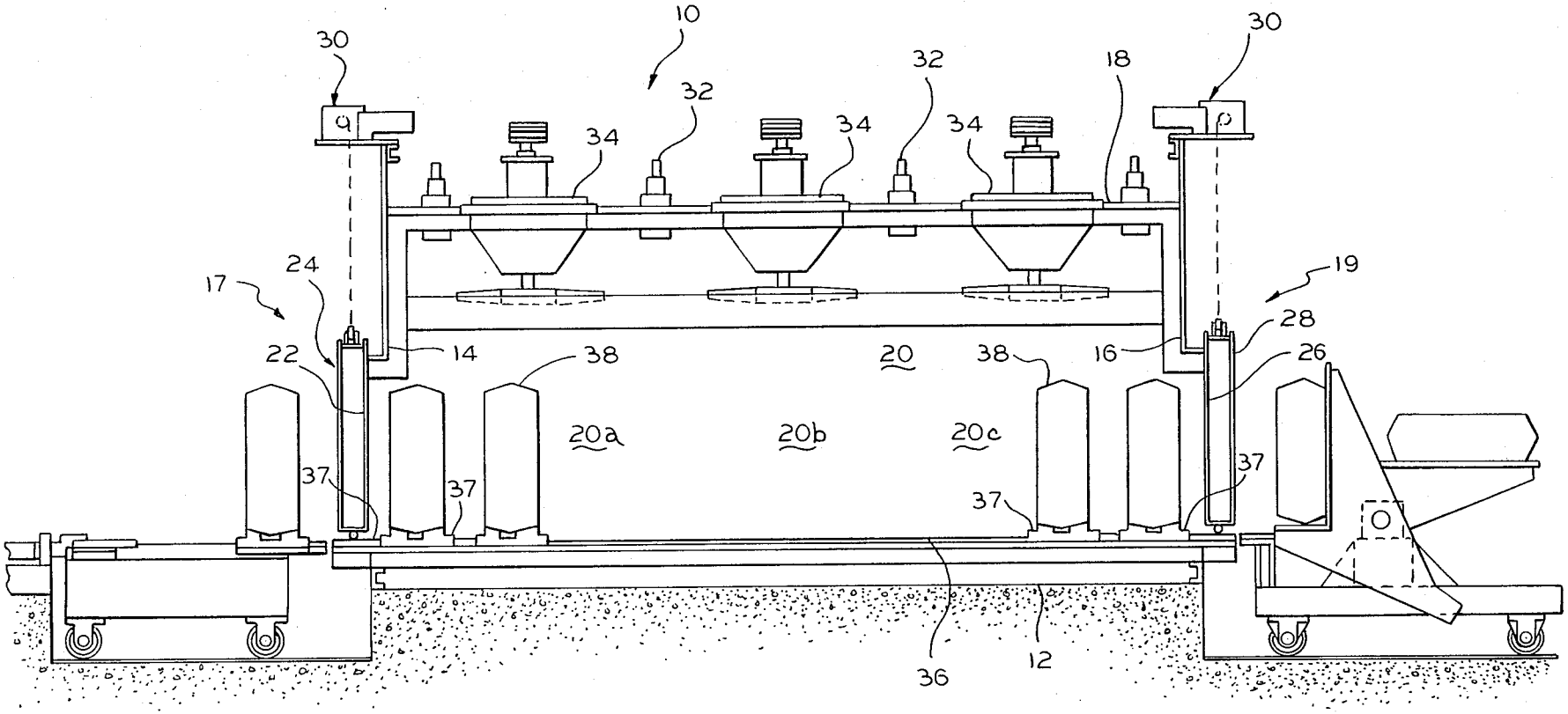
FIG. 1 (PRIOR ART)
FIG. 1 is a side elevational view of an ingot pusher furnace of the prior art.

Referring now in detail to the drawings, there is illustrated in FIG. 1 an ingot pusher furnace of the prior art designated generally by reference numeral 10. The pusher furnace 10 includes a bottom wall 12, a front wall 14, a rear wall 16, and a top wall or roof 18 which are used to define an insulated enclosure 20. The front wall 14 is formed a with a large entrance opening 22 which is covered by a front charging door 24. The rear wall 16 is formed with a large exit opening 26 is covered by a rear discharging door 28. The front charging and rear discharging doors 26, 28 are adapted to slide in a vertical plane under the control of elevating mechanisms 30 which are well known in the art.

A plurality of conventional gas burners 32 are positioned in the top wall 18 and deliver a hot gaseous medium to the insulated inclosure 20. In alternate embodiments of the pusher furnace, radiant tube gas fired or electric heaters may be utilized to heat the enclosure 20. The insulated enclosure 20 is divided into a plurality of heating zones 20*a*, 20*b* and 20*c*. The top wall 18 supports a plurality of large gas recirculating fan assemblies 34 which are used to move the hot gaseous medium within the heating zones of the enclosure. In the bottom wall 12, there are formed a plurality of support rails, one of which is depicted and designated by reference numeral 36, which facilitate the support and movement of a plurality of aluminum ingots 38 to be heated within the enclosure 20. The aluminum ingots 38 are substantially rectangular in shape and the underneath surface thereof are supported by respective shoe assemblies 37. The shoe assemblies are supported by the rails 36.

As can be seen from FIG. 1, the support rails 36 actually extend a predetermined distance beyond both the entrance opening 22 at the charging end 17 and the exit opening 26 at the discharging end 19 of the furnace 10. Thus, in the closed position the bottom of the charging door 24 will come to rest upon the top surface of the support rails 36. Similarly, in the closed position the bottom of the discharging door 28 will come to rest upon the top surface of the support rails 36. As a result, outside cold air is very likely to leak into the furnace enclosure 20 around the rails 36 at the location where they extend through the respective door openings 22, 26. Further, the hot gaseous medium within the enclosure 20 will be lost due to the leaks, causing wasting of energy and thus reducing the efficiency of the furnace.

In FIG. 1, there is shown one type of handling mechanism 40 referred to generally as an "up-ender" mechanism which is positioned at the charging end 17 of the furnace. The up-ender mechanism 40 may be located on an ingot transfer car or cart 41 and is used to push forward the ingots 38 to be heated into the furnace at the charging end thereof via the entrance opening 22. Further, another type of handling mechanism 42 such an ingot rotating mechanism referred generally to as a "down-ender" mechanism is positioned at the discharging end 19 of the furnace. The down-ender mechanism may also be located on an ingot transfer car or cart 43 and is used to carry the ingots 38 after heating away from the furnace via the exit opening 26.

Figure 2B:
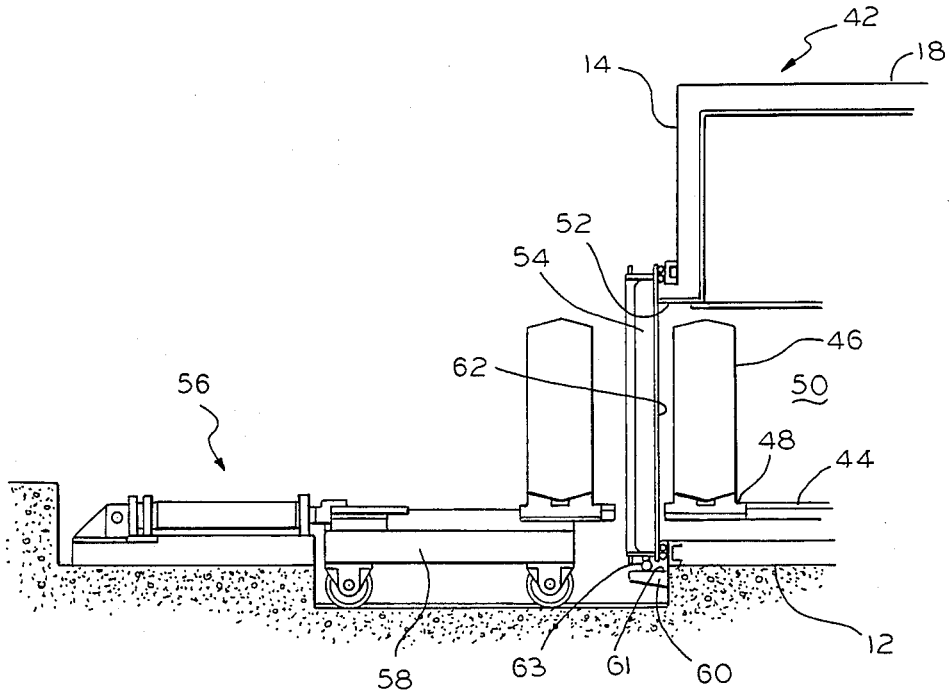
FIG. 2(*a*) is a side elevational view of an ingot pusher furnace of the present invention with an up-ender mechanism illustrating the charging door in the open position.
Figure 2A:
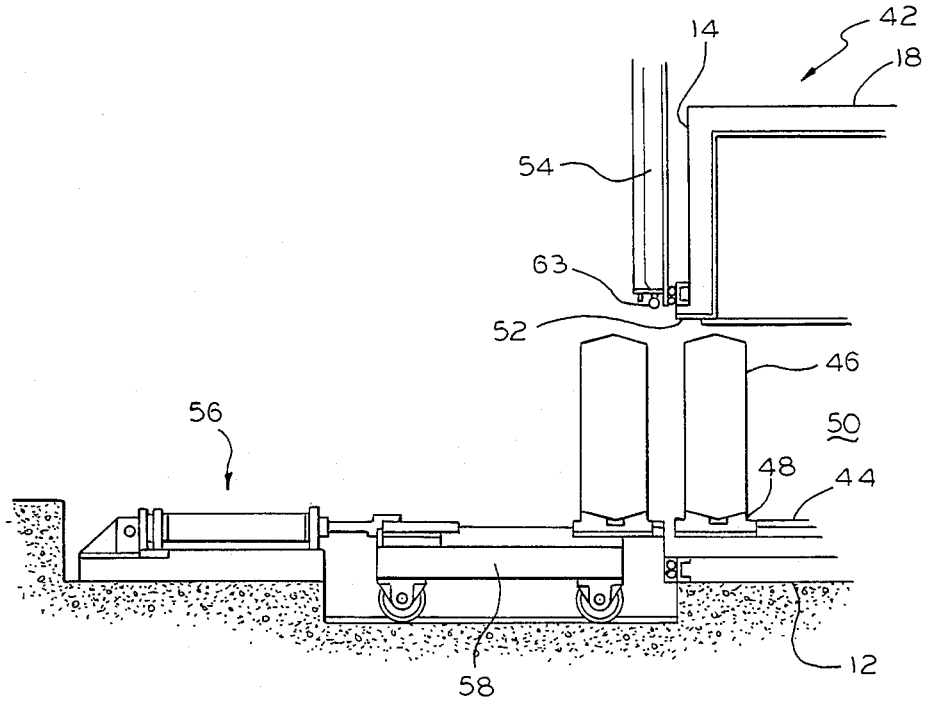

The present invention is an improvement over the ingot pusher furnace 10 of FIG. 1 and includes means for creating effective seals at the charging and discharging ends of the furnace so as to produce a more uniform heating of the ingots. In FIG. 2(*a*), there is shown a charging end portion of an improved ingot pusher furnace 42 of the present invention. The pusher furnace 42 includes support rails, one of which is depicted and designated by reference numeral 44, for facilitating the support and movement of the ingots 46 to be heated through its insulated enclosure 50. The rails 44 carry shoe assemblies 48 which are used to support the underneath surfaces of the aluminum ingots 46.

The support rails 44 are designed so as to terminate or end substantially at the entrance door opening 52 and do not extend beyond the door opening 52. With charging door 54 in its open position, an up-ender mechanism 56 similar to the handling mechanism 40 of FIG. 1 is used to push forward the ingot 46 and shoe assembly 48 into the furnace enclosure 50 and all of the ingots already within the furnace each are advanced a step forward. After the ingot has been pushed forward, the car or cart 58 carrying the up-ender mechanism 56 is moved back to a position shown in FIG. 2(*b*) and the charging door 54 is lowered by a suitable mechanism so as to assume a closed position. As will be noted in FIG. 2(*b*), the charging door 54 extends below the support rail 44 and comes to rest on a stop member 60. As a result, the ends of the rails terminate inside of the charging door 54 and are substantially flush with the interior surface 62 of the charging door thereby creating a positive seal at the lower end of the door.

The stop member 60 is disposed adjacent the front wall 14 and below the support rails 4. The stop member 60 is preferably of a triangular-shaped configuration and has a top surface 61. The bottom surface of the charging door 54 may be provided with a sealing member 63 for contacting the top surface of the top member 60 when the charging door is in the closed position.

Figure 3A:
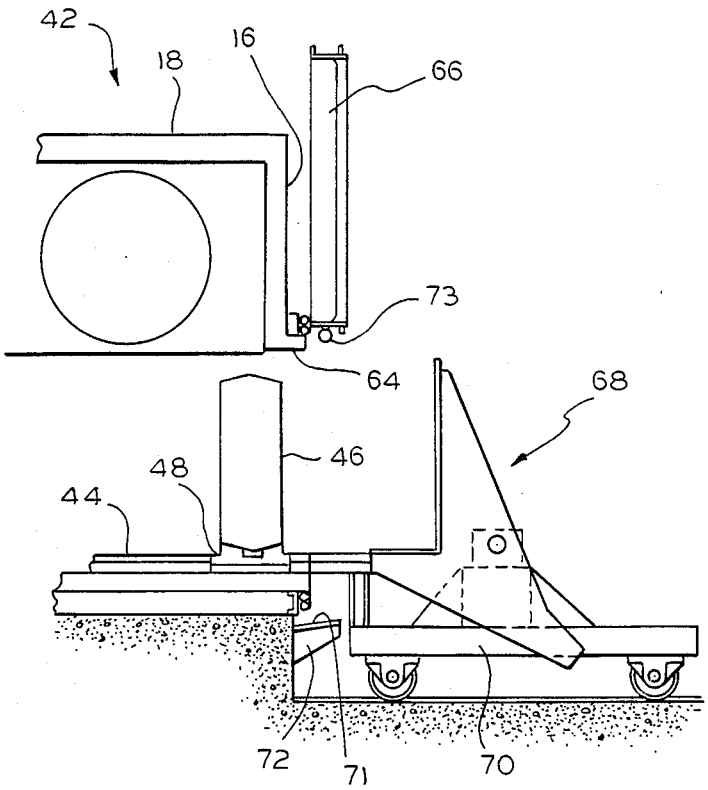
FIG. 3(*a*) is a side elevational view of an ingot pusher furnace of the present invention with a down-ender mechanism, illustrating the discharging door in the open position.
Figure 3B:
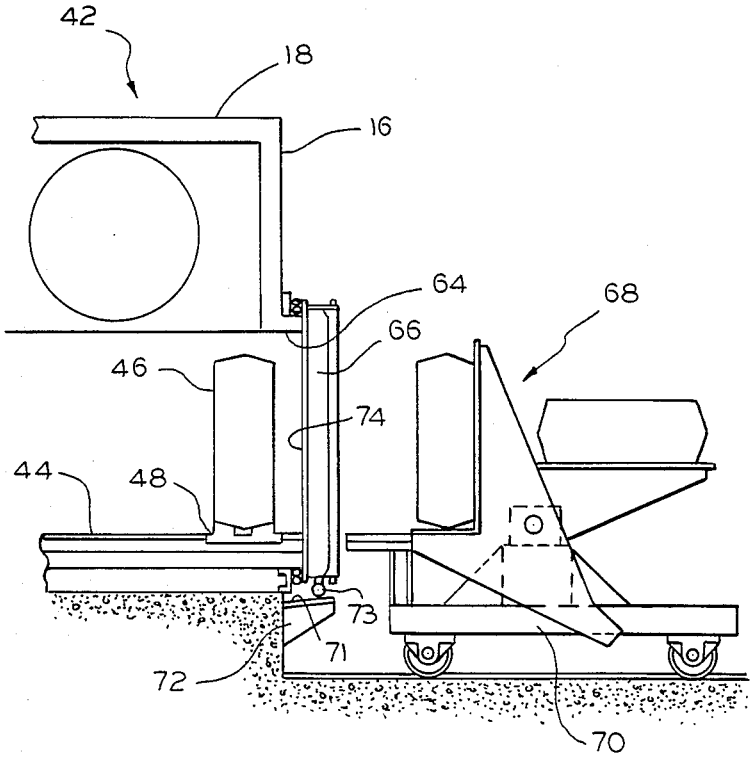

In FIG. 3(*a*) of the drawings, there is shown a discharging end portion of the improved ingot pusher furnace 42 of the present invention. Similarly, the support rails 44 terminate or end substantially at the exit door opening 64 and do not extend beyond the door opening 64. With discharging door 66 in its open position, a down-ender or ingot rotating mechanism 68 similar to the handling mechanism 42 of FIG. 1 is used to receive the heated ingots as they are discharged from the furnace. Then, the car or cart 70 carrying the down-ender mechanism 68 is moved away from the furnace to a position shown in FIG. 3(*b*) and the discharging door 66 is lowered by a suitable mechanism so as to assume a closed position. As can be seen in FIG. 3(*b*), the discharging door 66 extends below the rails 44 and the bottom thereof comes to rest on a stop member 72. Consequently, the ends of the rails 44 terminate inside of the discharging door 66 and are substantially flush with the interior surface 74 of the discharging door, providing a positive seal at the lower end of the door.

The stop member 72 is disposed adjacent the rear wall 16 and below support rails 44. The stop member 60 is preferably of a triangular-shaped configuration and has a top surface 71. The bottom surface of the discharging door 56 may be provided with a sealing member 73 for contacting the top surface of the stop member 72 when the discharging door 66 is in the closed position.

From the foregoing detailed description, it can thus be seen that the present invention provides an improved ingot pusher furnace which includes means for reducing heat loss from the charging and discharging ends of the furnace so as to produce a more efficient and uniform heating of the ingots. The pusher furnace of the present invention includes support rails extending between a first opening in the front wall and a second opening in the rear wall and terminating inside of the charging and discharging doors. Further, the charging and discharging doors extend below the support rails in their closed position so as to provide a positive seal.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. An ingot pusher furnace comprising:

an insulated furnace enclosure including a bottom wall, a front wall, a rear wall and a top wall, said enclosure receiving a plurality of ingots to be heated;

means for heating said enclosure by heating a gaseous medium therein;

means for moving said gaseous medium within said enclosure;

support rails being disposed in association with said bottom wall for facilitating support and movement of the ingots within said enclosure;

a charging door located adjacent said front wall and being adapted to close and opening formed in said front wall;

said support rails extending between said front wall and said rear wall and terminating inside of said charging door;

said charging door extending below said support rails in its closed position so as to provide a positive seal;

a stop member disposed adjacent said front wall and below said support rails; and said charging door including a seal formed on its bottom surface for contacting a top surface of said stop member when said charging door is in the closed position.

2. An ingot pusher furnace as claimed in claim 1, wherein said stop member has a triangular-shaped configuration.

3. An ingot pusher furnace comprising:

an insulated furnace enclosure including a bottom wall, a front wall, a rear wall and a top wall, said enclosure receiving a plurality of ingots to be heated;

means for heating said enclosure by heating a gaseous medium therein;

means for moving said gaseous medium within said enclosure;

support means being disposed in association with said bottom wall for facilitating support and movement of the ingots within said enclosure;

a charging door located adjacent said front wall and being adapted to close a first opening formed in said front wall;

a discharging door located adjacent said rear wall and being adapted to close a second opening formed in said rear wall;

said support means extending between said first opening in said front wall and said second opening in said rear wall and terminating inside of said charging and discharging doors;

said charging and discharging doors extending below said support means in their closed position so as to provide a positive seal;

a first stop member disposed adjacent said front wall and below said support means;

said charging door including a first seal formed on its bottom surface for contacting a top surface of said first stop member when said charging door is in the closed position;

a second stop member disposed adjacent said rear wall and below said support means; and said discharging door including a second seal formed on its bottom surface for contacting a top surface of said second stop member when said discharging door is in the closed position.

4. An ingot pusher furnace comprising:

an insulated furnace enclosure including a bottom wall, a front wall, a rear wall and a top wall, said enclosure receiving a plurality of ingots to be heated;

means for heating said enclosure by heating a gaseous medium therein;

means for moving said gaseous medium within said enclosure;

support rails being disposed in association with said bottom wall for facilitating support and movement of the ingots within said enclosure;

a charging door located adjacent said front wall and being adapted to close a first opening formed in said front wall;

a discharging door located adjacent said rear wall and being adapted to close a second opening formed in said rear wall;

said support rails extending between said first opening in said front wall and said second opening in said rear wall and terminating inside of said charging and discharging doors, the ends of said support rails being disposed substantially flush with the respective interior surfaces of said charging and discharging doors;

said charging and discharging doors extending below said support rails in their closed position so as to provide a positive seal;

a first stop member disposed adjacent said front wall and below said support rails;

said charging door including a first seal formed on its bottom surface for contacting a top surface of said first stop member when said charging door is in the closed position;

a second stop member disposed adjacent said rear wall and below said support rails; and said discharging door including a second seal formed on its bottom surface for contacting a top surface of said second stop member when said discharging door is in the closed position.

5. An ingot pusher furnace as claimed in claim 4, wherein said first stop member has a triangular-shaped configuration.

6. An ingot pusher furnace as claimed in cliam 4, wherein said second stop member has a triangular-shaped configuration.

7. An ingot pusher furnace as claimed in claim 4, wherein said means for moving said gaseous medium within said enclosure comprises at least one fan mounted upon the top wall of said enclosure.

* * * * *